United States Patent [19]

Shimoji et al.

[11] Patent Number: 4,513,841

[45] Date of Patent: Apr. 30, 1985

[54] MUFFLER FOR INTERNAL COMBUSTION ENGINES

[75] Inventors: Koji Shimoji, Okazaki; Suekiti Hangeisi, Toyota; Keiji Itou, Okazaki, all of Japan

[73] Assignee: Toyota Jidosha Kabushiki Kaisha, Japan

[21] Appl. No.: 541,282

[22] Filed: Oct. 12, 1983

[30] Foreign Application Priority Data

Apr. 1, 1983 [JP] Japan ..... 58-55286

[51] Int. Cl.[3] ..... F01N 1/10

[52] U.S. Cl. ..... 181/252; 181/272

[58] Field of Search ..... 181/241, 243, 249, 252, 181/255, 256, 264, 272, 281

[56] References Cited

U.S. PATENT DOCUMENTS 1,186,067 6/1916 Becker ..... 181/281
2,382,159 8/1945 Klemm ..... 181/241
4,192,402 3/1980 Nakagawa et al. ..... 181/256
4,236,597 12/1980 Kiss et al. ..... 181/264 X

FOREIGN PATENT DOCUMENTS 49-64738 6/1974 Japan .

*Primary Examiner*—Benjamin R. Fuller
*Attorney, Agent, or Firm*—Parkhurst & Oliff

[57] ABSTRACT

A muffler installed on an exhaust system of an internal combustion engine, which dissipates thermal stresses which arise from differing thermal expansions of the members comprising the muffler. The muffler comprises an outer cylinder, a pair of inner pipes, slidable into each other, penetrating into the outer cylinder and having a number of small holes therein, separators fixed to the outer cylinder by outer flanges provided with notches, and to the inner pipes by inner flanges, and the spaces defined by the inner pipes, separators and outer cylinder being filled with a sound absorbing material such as glass wool.

10 Claims, 11 Drawing Figures

MUFFLER FOR INTERNAL COMBUSTION ENGINES

BACKGROUND OF THE INVENTION

The present invention relates to a muffler for use in combination with an internal combustion engine, and more particularly to a muffler installed in an exhaust system of the engine in which thermal stresses created by a temperature differential between an inner pipe and an outer cylinder thereof, are decreased.

Generally, a conventional exhaust system comprises an exhaust pipe, through which the exhaust gas created by an engine flows, and a muffler for absorbing some of the sound waves associated with the exhaust gas. The conventional exhaust system is schematically represented by FIG. 1. A sub-muffler 1 is provided in a position between an exhaust manifold 5, which is connected to the engine, and a main muffler 6. The sub-muffler 1 primarily absorbs the high frequency components of the sound waves associated with the exhaust gas and further absorbs any resonance created in exhaust pipes 2, 3 and 4. FIGS. 2 and 3 disclose the two types of conventional sub-mufflers in existence, the resonance and expansion types. The resonance type muffler disclosed in FIG. 2, comprises an inner pipe 8, having a number of holes therein, and an outer cylinder 9. The exhaust gas flows into the muffler 9 through the pipe 8, and any associated exhaust noise is attenuated by resonance occurring within the chamber defined by the outer portion of the inner pipe 8 and the inner portion of the outer cylinder 9. The expansion type muffler disclosed in FIG. 3 comprises an inner pipe 10 and an outer cylinder 11. In the expansion type muffler shown in FIG. 3, the exhaust noise or sound of the exhaust gas is attenuated when the exhaust gas flowing through the inner pipe 10 expands into the chamber defined between an outer face of the inner pipe 10 and an inner face of the outer tube 11. According to these conventional sub-mufflers 1 and 2, the high frequency part of the exhaust noise is effectively attenuated or eliminated.

However, whenever a sub-muffler is placed in a conventional exhaust system, the flow resistance (back-pressure) of the system increases, thus reducing the engine's power and therefore lowers the combustion efficiency of the engine. Therefore, the conventional sub-mufflers are not sufficient to satisfy both the high frequency noise attenuation requirement and the low exhaust flow resistance requirement. In general, whenever the flow resistance in an exhaust system increases, the high frequency sound attenuation increases and conversely, when the flow resistance decreases, the high frequency sound attenuation also decreases. The afore-described sub-mufflers cannot achieve the desirable effects of low flow resistance and high sound attenuation.

To obviate the afore-mentioned disadvantages of the previously discussed conventional sub-mufflers, a sub-muffler as disclosed in FIG. 4, and which is described in Japanese laid open patent publication No. Sho 49-64738 has been introduced. According to the sub-muffler disclosed in FIG. 4, a sound absorbing fiber 12, consisting of glass wool, is filled into a space defined between an inner pipe 8 and an outer cylinder 9. Use of the sound absorbing fiber results in attenuation of high frequency exhaust noise without significantly increasing the back-pressure of the entire exhaust system. However, when the sound absorbing fiber is filled into the sub-muffler, it results in an increase in the temperature differential between the inner pipe 8 and the outer cylinder 9, resulting in a considerable difference in the amount of thermal expansion between the inner pipe 8 and the outer cylinder 9. Therefore, thermal stresses arise in the muffler assembly which may result in structural defects because there is no means provided to absorb the generated thermal stresses.

In order to obviate the problem of these generated thermal stresses, a sub-muffler, as disclosed in FIG. 5, has been conventionally employed. The structure of the sub-muffler disclosed in FIG. 5 combines features of both the resonance type sub-muffler and the expansion type sub-muffler. The inside space of sub-muffler 1 is filled with a sound absorbing fiber 12, and by a chamber 13 defined by a pair of separators 14, which aids in maintaining a small temperature differential between the inner pipe 10 and the outer cylinder 11. According to the sub-muffler disclosed in FIG. 5, there is no provision for any sound absorbing fiber 12 within the chamber 13. Consequently, the silencing effect attributed to attenuation of exhaust gas noise is not satisfactory. Further, the separators 14 are not fixed to the outer cylinder 11, thereby providing for absorbtion of any thermal stresses generated by the difference in temperature between the inner pipe 10 and the outer cylinder 11. However, when the muffler is subjected to externally created stresses, such as those arising from a vehicle traversing a rough road, the separators 14 slide relative to the outer cylinder 11, thus reducing the service expectancy of the sub-muffler because of the repeated oscillations.

SUMMARY OF THE INVENTION

The present invention was made in view of the foregoing background and to overcome the foregoing drawbacks. It is accordingly an object of this invention to provide a muffler for internal combustion engines which results in low back-pressure in the exhaust system, without significantly sacrificing exhaust noise attenuation.

To attain the above objects, a muffler for attenuating exhaust noise created in an engine and thereby transmitted into and through an exhaust pipe connected to the engine, according to the present invention, comprises:

an outer cylinder;

end plates closing both side ends of the outer cylinder and having openings therein;

inner pipes, being slidable relative to each other, inserted into the outer cylinder through the end plate openings and having a number of holes therein;

a plurality of separators for separating a space defined between the inner pipes and the outer cylinder, having outer flanges connected to inner face of the outer cylinder and inner flanges connected to an outer face of the inner pipes, the outer flanges having a notch therein; and, sound absorbing material filled into the space defined between the inner pipes, the separators and the outer cylinder, for absorbing the sound of the exhaust gas.

BRIEF DESCRIPTION OF THE DRAWINGS

The above and other objects, features and advantages of the present invention will become more apparent from reading the following description of the preferred embodiments taken in conjunction with the accompanying drawings, wherein.

DETAILED DESCRIPTION OF THE PREFERRED EMBODIMENTS

The present invention is described in detail with reference to the accompanying drawings which illustrate different embodiments of a sub-muffler for use in an engine's exhaust system according to the present invention.

Figure 1:
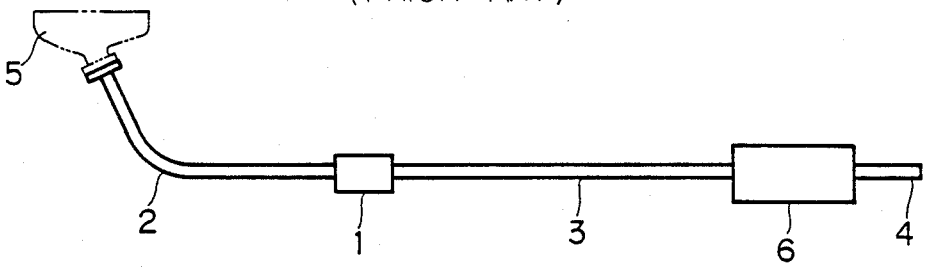
Fig. 1 (PRIOR ART)
FIG. 1 is a schematic illustration disclosing a typical exhaust system provided for a vehicle.
Figure 2:
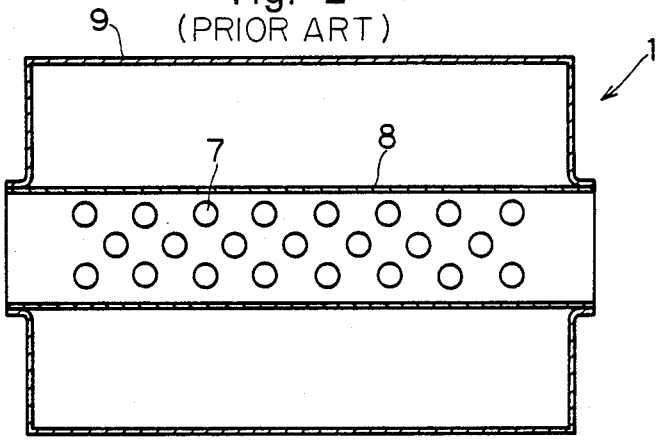
Fig. 2 (PRIOR ART)
FIG. 2 is a longitudinal cross-sectional view of a resonance type sub-muffler according to prior art.
Figure 3:
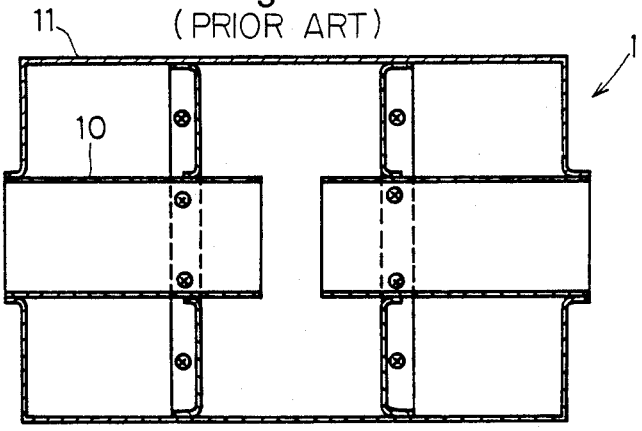
Fig. 3 (PRIOR ART)
FIG. 3 is a longitudinal cross-sectional view of an expansion type sub-muffler according to prior art.
Figure 4:
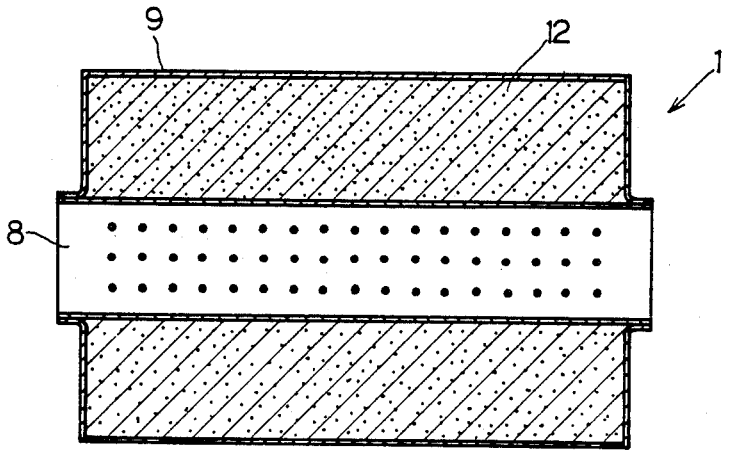
Fig. 4 (PRIOR ART)
FIG. 4 is a longitudinal cross-sectional view of another resonance type sub-muffler according to prior art.
Figure 6:
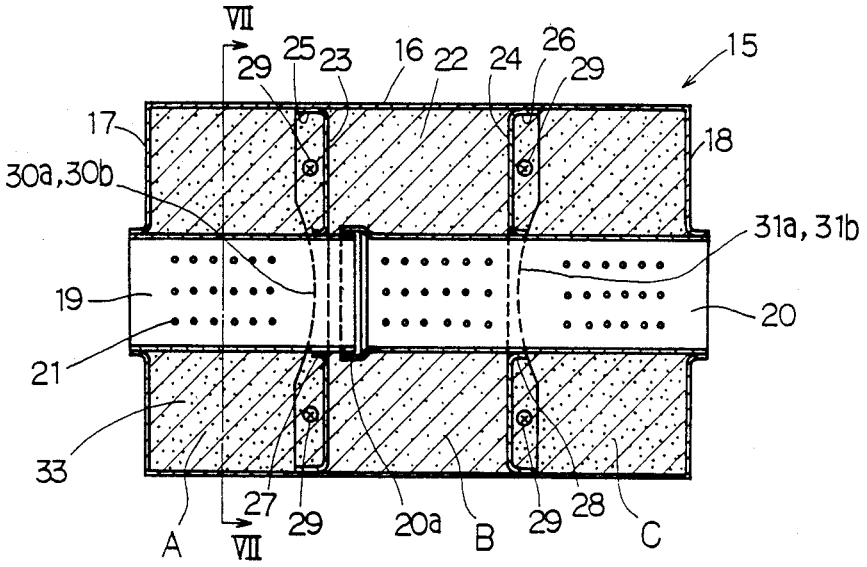
FIG. 6 is a longitudinal cross-sectional view of a sub-muffler according to an embodiment of the present invention.
Figure 7:
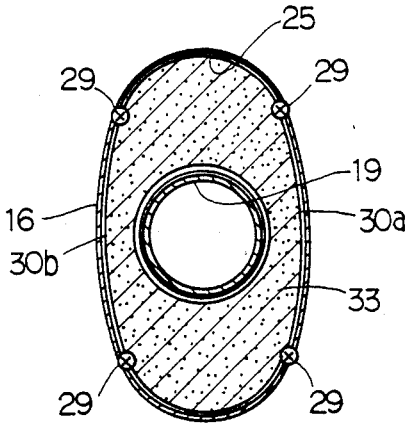
FIG. 7 is a transverse cross-sectional view taken along the line VII—VII of FIG. 6.
Figure 8:
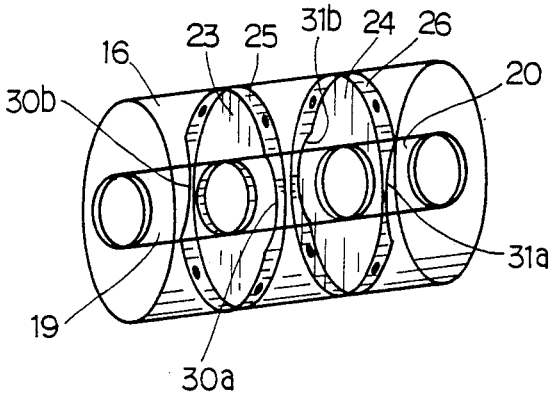
FIG. 8 is a perspective view illustrating the sub-muffler shown in FIG. 6.
Figure 9:
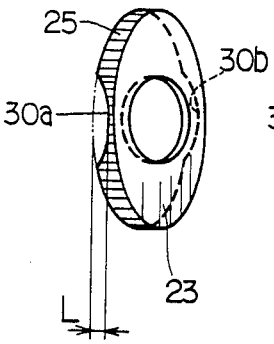
FIG. 9 is a perspective view illustrating the separator of the muffler dislosed in FIG. 6.

FIGS. 6 through 9 illustrate a sub-muffler which is to be mounted in the exhaust system of an engine in accordance with a first embodiment of the present invention. The sub-muffler 15 is provided in a position between an exhaust manifold 5 and a main muffler 6, as shown in FIG. 1. The sub-muffler 15 is connected with the exhaust pipe 2 at the front end thereof and with the exhaust pipe 3 at the rear end thereof, respectively. The exhaust pipe 2 is connected with the exhaust manifold 5 at the front end thereof. The exhaust pipe 3 is connected with the main muffler 6 at the rear end thereof. FIGS. 6 through 9 show that the outer cylinder 16 has an oval shaped transverse cross-section. The end plates 17 and 18 are secured to the outer cylinder 16. Inner pipes 19 and 20 are inserted into the sub-muffler 15 through the holes provided in the end plates 17 and 18, respectively, and are fixed to the plates by welding techniques. The inner diameter of the front end portion of the inner pipe 20 (the left side of the pipe in FIG. 6) is slightly enlarged so that the rear portion of the inner pipe 19 can be slidably engaged with the enlarged portion 20*a* of the inner pipe 20. The wall of pipes 19 and 20 include a number of small holes 21 therein. The small holes 21 functionally connect the inner pipes 19 and 20 with a silencing chamber 22, which is defined as the space between the outer face of the inner pipes 19 and 20 and the inner face of the outer cylinder 16. Separators 23 and 24 are provided within the silencing chamber 22. The separators 23 and 24 divide the silencing chamber 22 into the three chambers A, B and C, as indicated in FIG. 6. Flanges 25 and 26 are provided at the outer peripheral portion of the separators 23 and 24, respectively, and connect the separators 23 and 24 with the outer cylinder 16. Further, the separators 23 and 24 have inner flanges 27 and 28 which are contacted with the outer peripheral face of the inner pipes 19 and 20, respectively. Hence, the separators 23 and 24 are oval-shaped and are provided with a circular hole near their respective middle portions.

The flanges 25 and 26 of the separators 23 and 24 are fixed to the outer cylinder 16 by a spot welding technique. An appropriate number of spot welds are provided on the circular portion of the flanges 25 and 26. According to the present embodiment, the number of spot welds used is four. The spot welds 29 are not provided on the part of the flanges 25 and 26 which corresponds to the minor axis of the oval-shaped assembly. The flanges 27 and 28 of the separators 23 and 24 are fixed to inner pipes 19 and 20, respectively, by similar spot welding techniques.

Figure 10:
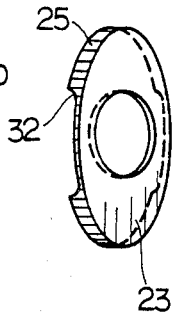
FIG. 10 is a perspective view of another separator.
Figure 11:
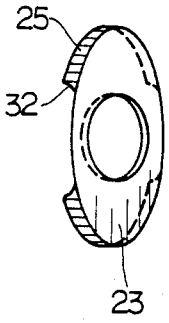
FIG. 11 is a perspective view of another separator design.

Notches 30*a* and 30*b* are provided on the separator 23 and notches 31*a* and 31*b* are provided on the separator 24. The aforementioned notches are circular shaped and are provided in a position corresponding to the minor axis of the muffler assembly and therefore, there are no spot welds provided near the respective notches 30*a*, 30*b*, 31*a*, and 31*b*. The notches 30*a* and 30*b* are symmetrically provided on the flange 25, and the notches 31*a* and 31*b* are symmetrically provided on the flange 26. The shape of the notches 30*a*, 30*b*, 31*a* and 31*b* is not limited to the circular arc form disclosed in FIG. 9, but can also take the form of the notches disclosed in FIGS. 10 and 11. The notches disclosed in FIGS. 10 and 11 comprise a plane which is substantially parallel to the outer peripheral plane of the flange 25. The depth L of the notch disclosed in FIG. 9 can be less than or equal to the width of the flange 25. FIG. 10 shows a notch where L is less than the width of the flange 25 and FIG. 11 shows a notch where L is equal to the width of the flange 25.

A sound absorbing material 33, consisting of a heat-proof fiber such as glass wool, is filled into the silencing chambers A, B and C, respectively.

In the operation of the above-described muffler of the present invention, the exhaust gas in the combustion chamber of the engine is discharged into the exhaust manifold 5. The exhaust gas then flows to the sub-muffler 15 through the exhaust pipe 2. The exhaust noise, or sound of the exhaust gas, is attenuated by the sub-muffler 15 and the exhaust gas subsequently flows into the main muffler 6 through the exhaust pipe 3. After the exhaust noise is further attenuated by the main muffler 6, the exhaust gas is discharged into the atmosphere through the exhaust pipe 4.

Figure 5:
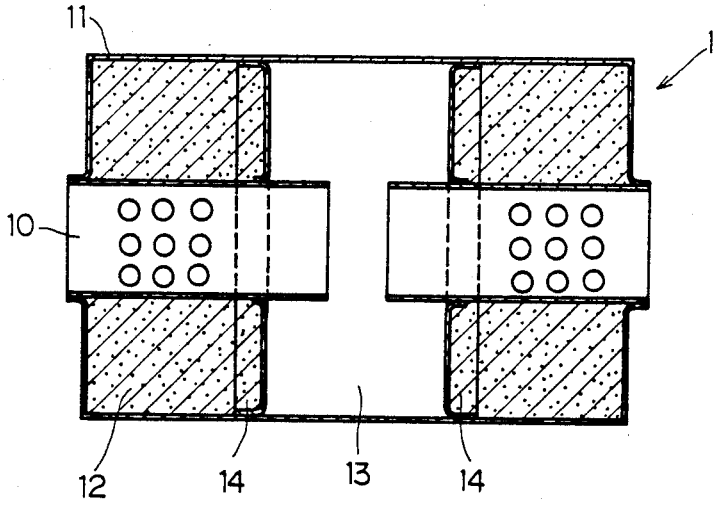
Fig. 5 (PRIOR ART)
FIG. 5 is a longitudinal cross-sectional view of a combination of a resonance and expansion type sub-muffler according to the prior art.

The exhaust noise transmitted into the sub-muffler 15 through the exhaust pipe 2 is propagated into the silencing chambers A, B and C, through the small holes 21 of inner pipes 19 and 20. The propagated exhaust noise is absorbed by the sound absorbing material 33 which is filled into the silencing chambers A, B and C. As apparent from FIG. 6, the sound absorbing material 33 is provided in the entirety of space defined between the outer tube 16 and the inner pipes 19 and 20. Consequently, the exhaust noise transmitted into the sub-muffler 15 is effectively absorbed by the sound absorbing material 33. Contrary to this, the prior art sub-muffler of FIG. 5 does not have means to effectively absorb the sound in each chamber, because there is no sound absorbing material 12 provided within the intermediate chamber 13. Hence, the prior art sub-muffler of FIG. 5 does not attenuate the exhaust noise as effectively as the sub-muffler of the present invention.

As the inner pipes 19 and 20 reach a temperature which nearly equals the high temperature of the exhaust gas, thermal stress gradients arise. This condition occurs because the sound absorbing material also acts as a thermal insulator thus maintaining the temperature of the outer tube 16 at a much lower temperature than the inner pipes 19 and 20. Therefore, a significant difference in the amount of thermal expansion occurs between the inner pipes 19 and 20 and the outer tube 16, thus resulting in thermal stresses at the joint portions between the separators 23 and 24 with outer cylinder 16, and the inner pipes 19 and 20. However, because the flanges 25 and 26 are provided with the notches 30*a*, 30*b*, 31*a* and 31*b* therein, the rigidity of the flanges 25 and 26 and the separators 23 and 24 is partially reduced. This allows the flanges and separators to be more flexible. Therefore, the thermal stresses created by the temperature differential between the outer cylinder 16 and the inner pipes 19 and 20, are reduced to an insignificant value because of the flexibility given to the flanges and separators by the addition of the notches. Hence, the separators 23 and 24 are less rigid and therefore allow for flexibility between the outer cylinder 16 and the inner pipes 19 and 20, which is necessary when such large temperature gradients give rise to large differences in the thermal expansion of the different members comprising the sub-muffler assembly.

Further, the inner pipes 19 and 20 are fixed by welding techniques to the end plates 17 and 18 of the outer cylinder. However the thermal expansion in the longitudinal direction of the inner pipes 19 and 20 is absorbed at the joint portion which connects the inner pipe 19 with the inner pipe 20 by utilizing a slidable joint. Consequently, the thermal expansion of the inner pipes 19 and 20 does not create any thermal stresses within the assembly. Also, because the separators 23 and 24 are fixed by spot welding to the inner pipes 19 and 20 and the outer cylinder 16, the separators do not slide relative to the inner pipe and the outer cylinder, and the inner pipes 19 and 20 are fixed to the separators 23 and 24 which are secured to the outer cylinder 16, thereby firmly holding the inner pipes 19 and 20. This assembly procedure results in a sub-muffler assembly with increased endurance over the prior art sub-mufflers disclosed herein.

In the present embodiment, the depth L of the notch and the length of the notch in the separators 23 and 24, can be adjusted to obtain the proper combination of rigidity and flexibility, thereby allowing the separators 23 and 24 to flex when subjected to differing thermal expansions while still providing support to the sub-muffler assembly.

Hence, the resultant sub-muffler has low exhaust flow resistance, while maintaining high exhaust noise attenuation, while simultaneously achieving a longer service expectancy than conventional sub-muffler designs.

While the present invention has been described in its preferred embodiments, it is to be understood that the invention is not limited thereto, and may be otherwise embodied within the scope of the following claims.

What is claimed is:

1. A muffler for absorbing noise created by an engine and transmitted therefrom through an exhaust pipe connected to the engine, comprising:

an outer cylinder;

end plates closing both ends of the outer cylinder and having openings therein;

inner pipes, being slidable relative to each other, inserted into the outer cylinder through the end plate openings and having a number of holes therein;

a plurality of separators for separating a space defined between the inner pipes and the outer cylinder, having outer flanges connected to the inner face of the outer cylinder and inner flanges connected to the outer faces of the inner pipes, the outer flanges having notches therein to provide for flexibility between the outer cylinder and the inner pipes; and sound absorbing material in the space defined between the inner pipes, the separators and the outer cylinder.

2. The muffler of claim 1, wherein the outer flange is fixed to the inner peripheral face of the outer cylinder by spop welding at points other than those corresponding to the notched outer flanges.

3. The muffler of claim 2, wherein the cross-sectional shape of the separators is oval and the notch on the outer flange is symmetrically provided on the minor axis of the oval separator.

4. The muffler of claim 1, wherein the cross-sectional shape of the openings in the end plates is circular.

5. The muffler of claim 1, wherein one of the inner pipes has an enlarged end portion into which an end of another inner pipe is slidably received.

6. The muffler of claim 1, wherein the notch has a circular arc shape.

7. The muffler of claim 1, wherein the bottom portion of the notch is parallel to the plane of the separator.

8. The muffler of claim 1, wherein the depth of the notch is less than that of the outer flange.

9. The muffler of claim 1, wherein the depth of the notch is the same as that of the outer flange.

10. A muffler for absorbing noise created by an engine and transmitted therefrom through an exhaust pipe connected to the engine, comprising:

an outer cylinder;

end plates closing both ends of the outer cylinder and having openings therein;

inner pipes being slidable relative to each other, inserted into the outer cylinder through the end plate openings and having a number of holes therein;

a plurality of separators having an ovular cross-sectional shape, for separating a space defined between the inner pipes and the outer cylinder, having outer flanges connected to the inner face of the outer cylinder and inner flanges connected to the outer faces of the inner pipes, the outer flanges having symmetrically provided notches, said notches being symmetrically provided about a minor axis of said ovular cross-sectional separators and providing for flexibility between the outer cylinder and the inner pipes; and sound absorbing material in the space defined between the inner pipes, the separators and the outer cylinder.

* * * * *